US009205962B2

(12) United States Patent
Holderby

(10) Patent No.: US 9,205,962 B2
(45) Date of Patent: Dec. 8, 2015

(54) SYSTEM FOR SEGREGATING AND IDENTIFYING CONTAINED MATERIAL IN A COOLER AND PROCESS FOR USING THE SAME

(71) Applicant: William Guy Holderby, Moreno Valley, CA (US)

(72) Inventor: William Guy Holderby, Moreno Valley, CA (US)

( * ) Notice: Subject to any disclaimer, the term of this patent is extended or adjusted under 35 U.S.C. 154(b) by 227 days.

(21) Appl. No.: 14/137,541

(22) Filed: Dec. 20, 2013

(65) Prior Publication Data

US 2015/0175327 A1 Jun. 25, 2015

(51) Int. Cl.

| | |
|---|---|
| ***B65D 25/20*** | (2006.01) |
| ***B65D 51/24*** | (2006.01) |
| ***F25D 3/08*** | (2006.01) |
| ***F25D 23/02*** | (2006.01) |
| ***F25D 11/00*** | (2006.01) |
| ***B65D 25/02*** | (2006.01) |

(52) U.S. Cl.

CPC ..... *B65D 51/245* (2013.01); *B65D 25/02* (2013.01); *B65D 25/205* (2013.01); *F25D 3/08* (2013.01); *F25D 11/003* (2013.01); *F25D 23/02* (2013.01); *B65D 2203/00* (2013.01); *F25D 2303/081* (2013.01)

(58) Field of Classification Search

CPC .. B65D 51/245; B65D 25/04; B65D 2203/00; F25D 3/08

See application file for complete search history.

(56) References Cited

U.S. PATENT DOCUMENTS

| | | | | |
|---|---|---|---|---|
| 752,463 | A * | 2/1904 | Morris | B65D 9/34 206/803 |
| 4,595,246 | A * | 6/1986 | Bross | B65D 25/04 108/60 |
| 4,964,528 | A * | 10/1990 | Wagoner | F25D 23/069 220/541 |
| 6,039,202 | A * | 3/2000 | Olstad | A45C 11/20 220/23.88 |
| 6,105,654 | A * | 8/2000 | Martel | F25D 23/069 16/225 |
| 7,344,044 | B2 * | 3/2008 | Bradford | B92C 66/542 220/507 |
| 7,905,038 | B2 * | 3/2011 | Coff | A47J 41/00 206/459.5 |
| 2002/0095947 | A1 * | 7/2002 | Treppedi | A45C 11/20 62/457.9 |
| 2003/0101744 | A1 * | 6/2003 | Harper | F25D 3/08 62/461 |
| 2004/0238543 | A1 * | 12/2004 | Askew | B65D 81/3816 220/529 |
| 2004/0262319 | A1 * | 12/2004 | Fisher | F25D 3/08 220/592.03 |
| 2009/0045204 | A1 * | 2/2009 | Marganski | A45C 11/20 220/592.03 |
| 2010/0212351 | A1 * | 8/2010 | Chapin | F25D 3/08 62/457.5 |

OTHER PUBLICATIONS

"Full Box of Whitman's Sampler," https://www.flickr.com/photos/29923994@N03/3147453283/, Dec. 29, 2008.*

* cited by examiner

*Primary Examiner* — Gary Hoge
(74) *Attorney, Agent, or Firm* — Plager Schack LLP

(57) ABSTRACT

A system configured to segregate and identify contained materials in a cooler having a cooler lid. The system has a long panel with a long panel slot connected to a short panel slot on a short panel configured within the cooler and dividing the cooler into a four sections. A map is detachably coupled to the cooler lid and comprises map sections which coordinate with the cooler sections. The map sections are then marked to identify the contents in the cooler sections.

5 Claims, 4 Drawing Sheets

SYSTEM FOR SEGREGATING AND IDENTIFYING CONTAINED MATERIAL IN A COOLER AND PROCESS FOR USING THE SAME

BACKGROUND

The embodiments herein relate generally to processes for storing and identifying goods.

Prior to embodiments of the disclosed invention, one would have to dig around in an ice chest looking for a specific item. Embodiments of the disclosed invention solve this problem. The prior art includes: U.S. Pat. No. 6,474,097 issued to Treppedi; U.S. Pat. No. 6,027,344 issued to Bowen; and U.S. Pat. No. 5,755,180 issued to Smith.

Treppedi teaches a cooler with a partition. However, it does not have a labeling system. There is a multi-partition divider in Smith, but, again, no labeling system. Bowen teaches a divider without a partition.

SUMMARY

A system is configured to segregate and identify contained materials in a cooler having a cooler lid. The system has a long panel with a long panel slot connected to a short panel slot on a short panel configured within the cooler and dividing the cooler into a top left cooler section, a top right cooler section, a bottom left cooler section and a bottom right cooler section. A map is detachably coupled to the cooler lid and proximate the long panel wherein the map comprises map divider lines dividing the map into a top left map section, a top right map section, a bottom left map section and a bottom right map section.

The top left map section is configured to identify top left contained materials in a top left marking area. The top right map section is configured to identify top right contained materials in a top right marking area. The bottom left map section is configured to identify bottom left contained materials in a bottom left marking area. The bottom right map section is configured to identify bottom right contained materials in a bottom right marking area.

In some embodiments, a second short panel having a second short panel slot is connected to a second long panel slot in the long panel further dividing the long panel into a top center cooler section and a bottom center cooler section. The map further comprises a top center map section and a bottom center map section. The top center map section is configured to identify top center contained materials in a top center marking area. The bottom center map section is configured to identify bottom center contained materials in a bottom center marking area.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
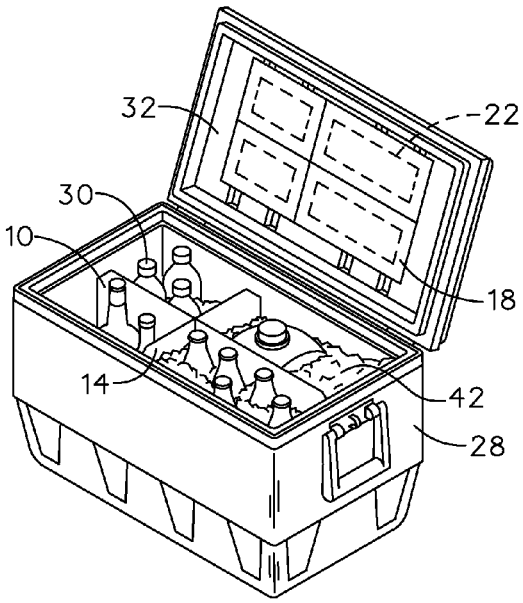
FIG. 1 is a perspective view of an embodiment of the invention, shown in use.
Figure 2:
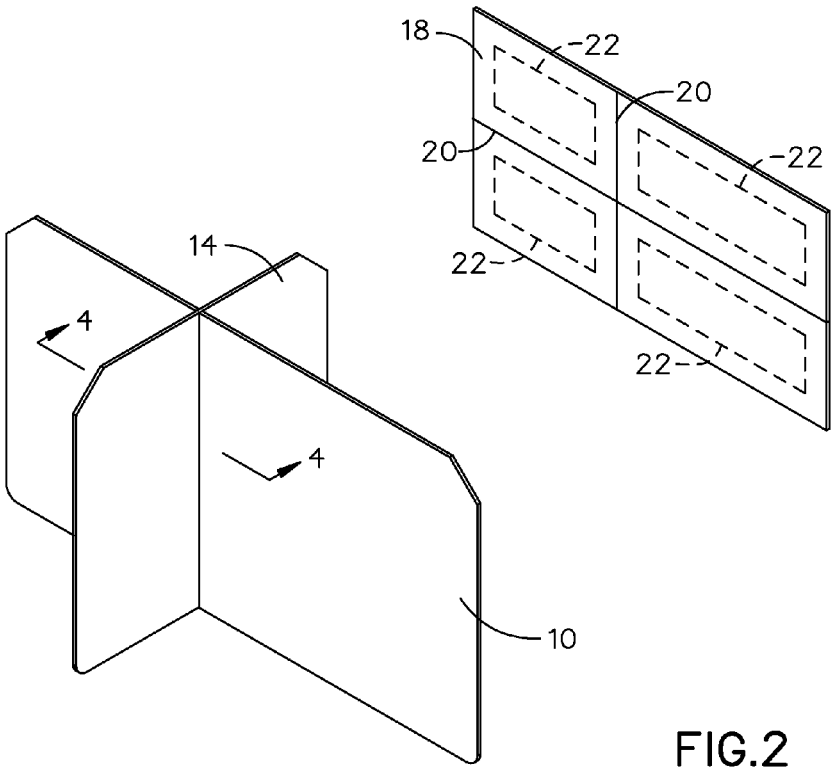
FIG. 2 is a perspective view of an embodiment of the invention.

By way of example, and referring to FIG. 1 and FIG. 2, cooler 28 is rotationally coupled to lid 32. The system comprises long panel 10 attached to short panel 14 and then inserted into cooler 28. This divides cooler 28 into a top left cooler section, a top right cooler section, a bottom left cooler section and a bottom right cooler section. Cooler 28 is then filled with contained materials 30. Contained materials 30 can be bottles and cans of liquids, perishable food and medicine or anything else that the user desires to cool. Contained materials 30 are then covered in ice 42.

Even if contained materials 30 are completely covered in ice 42, contained materials 30 can still be identified by map 18. Map 18 comprises horizontal dividing line 20 bisected by vertical dividing line 20 dividing map 18 into a top left map section, a top right map section, a bottom left map section and a bottom right map section. The top left map section comprises top left marking area 22. The top right map section comprises top right marking area 22. The bottom left map section comprises bottom left marking area 22. The bottom right map section comprises bottom right marking area 22.

After inserting top left contained materials 30 into top left cooler section a user can label top left marking area 22 identifying top left contained materials 30. Next, inserting top right contained materials 30 into top right cooler section and labeling top right marking area 22 identifying top right contained materials 30. Then, inserting bottom left contained materials 30 into bottom left cooler section and labeling bottom left marking area 22 identifying bottom left contained materials 30. After that, inserting bottom right contained materials 30 into bottom right cooler section and labeling bottom right marking area 22 identifying bottom right contained materials 30.

Figure 3:
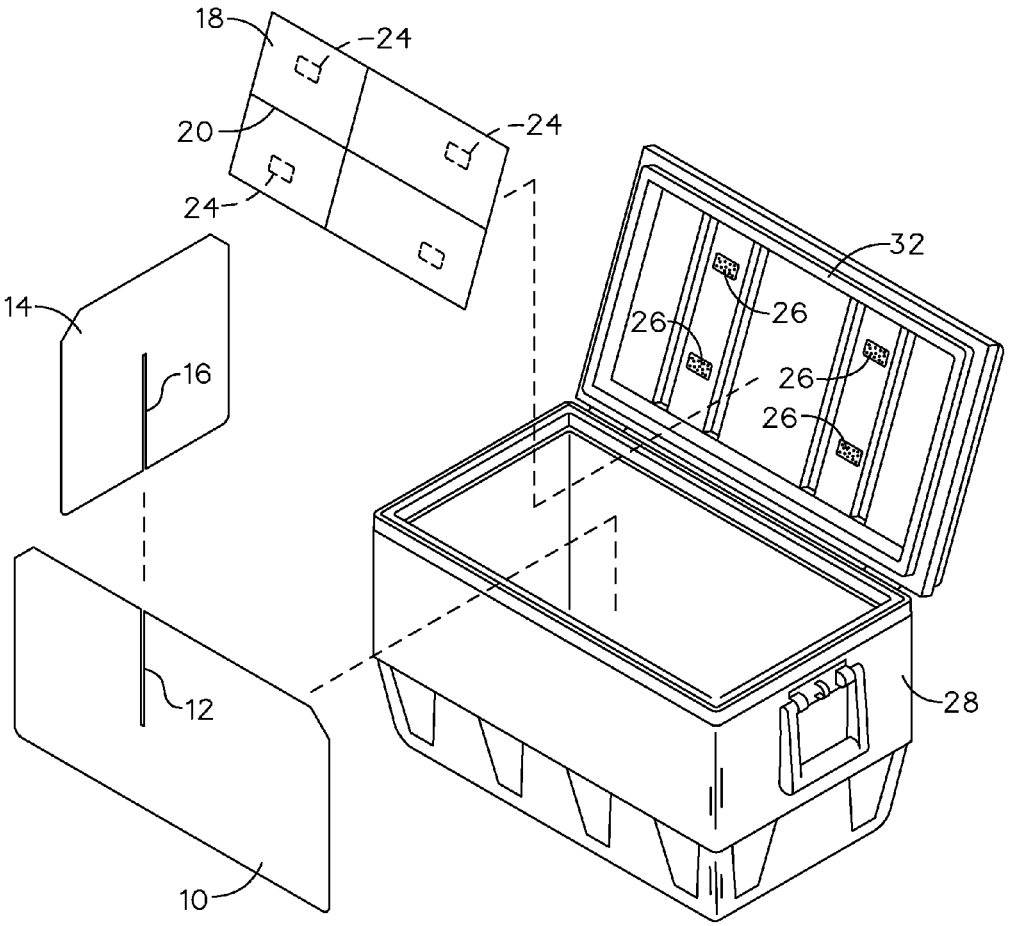
FIG. 3 is an exploded view of an embodiment of the invention.
Figure 4:
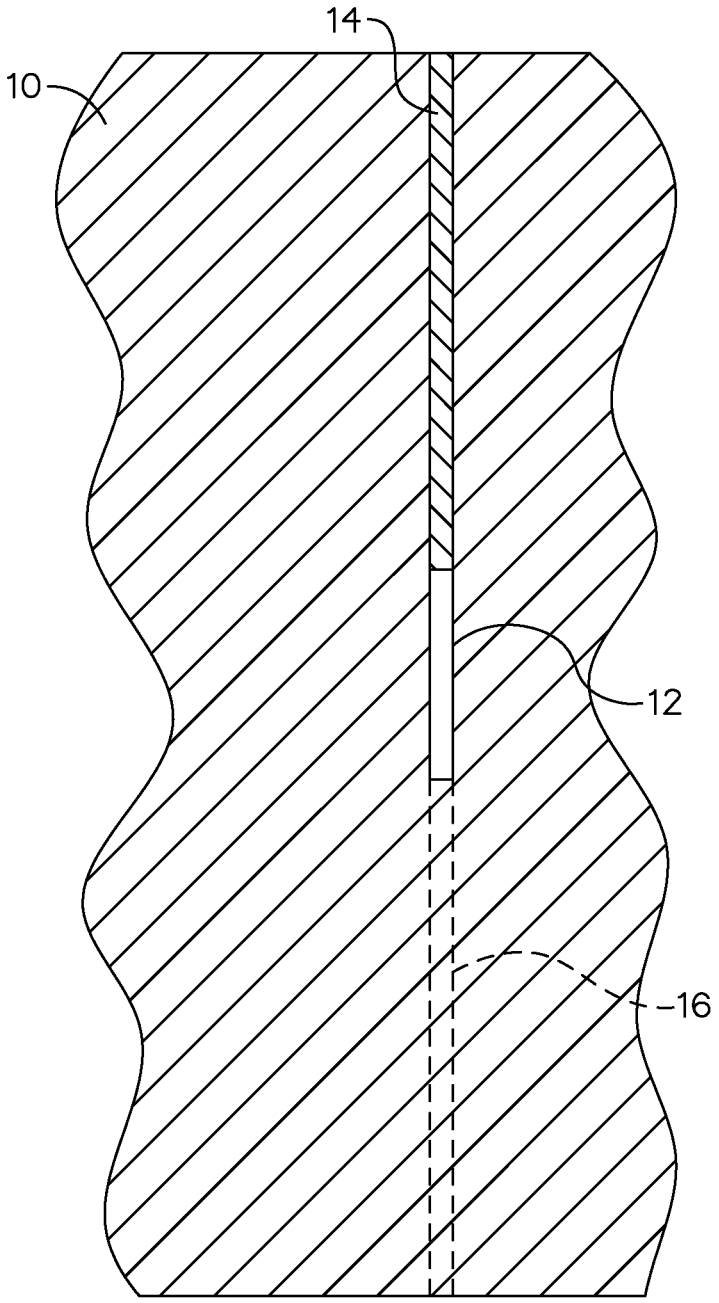
FIG. 4 is a detail section view of an embodiment of the invention, taken along line 4-4 in FIG. 2.

FIG. 3 and FIG. 4 provide assembly instructions for the system. Long panel 10 comprises long panel slot 12. Long panel slot 12 extends from a long panel centroid to a long panel edge. Short panel 14 comprises short panel slot 16. Short panel slot 16 extends from a short panel centroid to a short panel edge. To make the system a user simply inserts short panel slot 16 into long panel slot 12.

After this, a user can affix top left fastener lid strip 26, top right fastener lid strip 26, bottom left fastener lid strip 26 and bottom right fastener lid trip 26 to cooler lid 32. Likewise, the user can affix top left fastener map strip 26, top right fastener map strip 26, bottom left fastener map strip 26 and bottom right fastener map trip 26 to the back of map 18. The user can then affix map 18 to cooler lid 32. Of course, this can also be done with many kinds of fasteners, but hook and loop fasteners have been effective.

Figure 5:
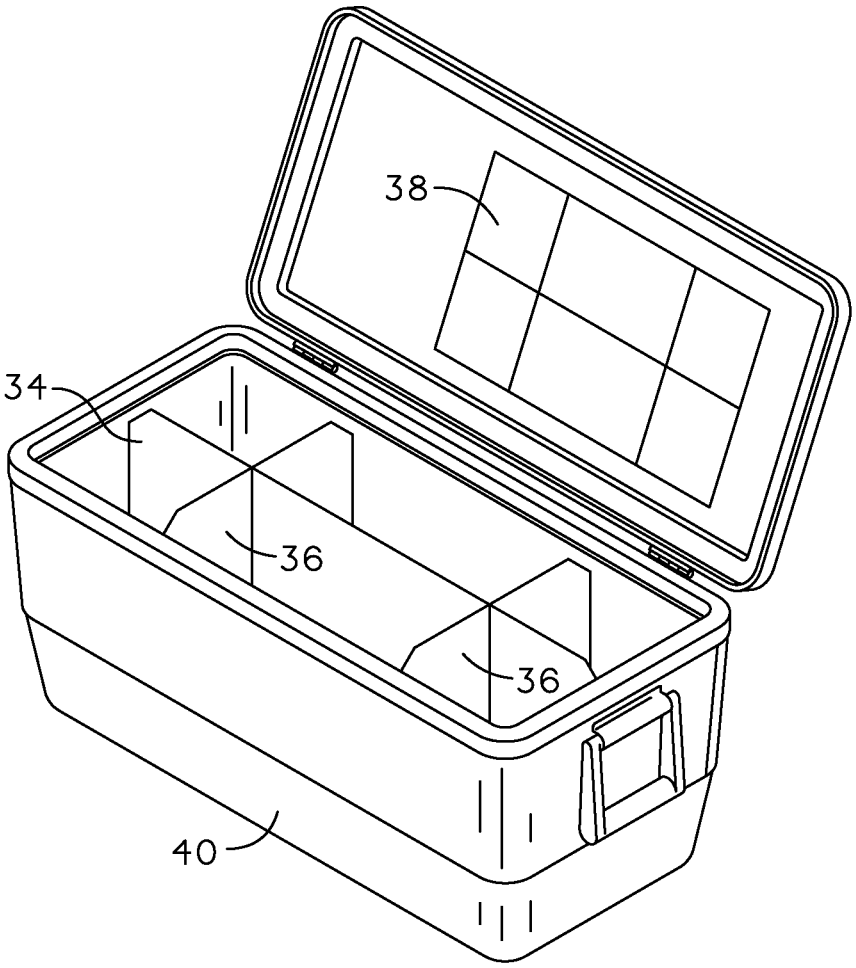
FIG. 5 is a perspective view of an embodiment of the invention.

Turning to FIG. 5, this geometry is not exclusive. Here long panel 34 has a first long panel slot and a second long panel slot. The first long panel slot can accommodate first short panel 36 and the second long panel slot can accommodate second short panel 36.

This configuration results in a top center section capable of containing top center material 30 and a bottom center section capable of containing bottom center material 30. Likewise, map 38 now contains a bottom center map section with bottom center marking area 22 and a top center map section with top center marking area.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A system configured to segregate and identify contained materials in a cooler having a cooler lid, the system comprising:

a long panel with a long panel slot connected to a short panel slot on a short panel configured within the cooler and dividing the cooler into a top left cooler section, a top right cooler section, a bottom left cooler section and a bottom right cooler section; and a map detachably coupled to the cooler lid and proximate the long panel wherein the map comprises map divider lines dividing the map into a top left map section, a top right map section, a bottom left map section and a bottom right map section;

wherein the top left map section is configured to identify top left contained materials in a top left marking area;

wherein the top right map section is configured to identify top right contained materials in a top right marking area;

wherein the bottom left map section is configured to identify bottom left contained materials in a bottom left marking area;

wherein the bottom right map section is configured to identify bottom right contained materials in a bottom right marking area.

2. The system of claim 1, further comprising:

a second short panel having a second short panel slot connected to a second long panel slot in the long panel further dividing the long panel into a top center cooler section and a bottom center cooler section; and the map further comprising a top center map section and a bottom center map section;

wherein the top center map section is configured to identify top center contained materials in a top center marking area;

wherein the bottom center map section is configured to identify bottom center contained materials in a bottom center marking area.

3. A process for segregating and identifying contained material in a cooler attached to a cooler lid; the process comprising:

forming a divider by attaching a long panel with a long panel slot connected to a short panel slot having a short panel slot;

inserting the divider into the cooler creating a top left cooler section, a top right cooler section, a bottom left cooler section and a bottom right cooler section;

attaching a map to the cooler lid; wherein the map comprises map divider lines dividing the map into a top left map section, a top right map section, a bottom left map section and a bottom right map section;

inserting top left contained materials into the top left cooler section;

inserting top right contained materials into the top right cooler section;

inserting bottom left contained materials into the bottom left cooler section;

inserting bottom right contained materials into the bottom right cooler section;

marking a top left marking area on the top left map section identifying the top left contained materials;

marking a top right marking area on the top right map section identifying the top right contained materials;

marking a bottom left marking area on the bottom left map section identifying the bottom left contained materials; and marking a bottom right marking area on the bottom right map section identifying the bottom right contained materials.

4. The process of claim 3, further comprising:

attaching the long panel to a second short panel forming a top center cooler section and a bottom center cooler section;

adjusting the map forming a top center map section and a bottom center map section;

inserting top center contained materials into the top center cooler section;

inserting bottom center contained materials into the bottom center cooler section;

marking the top center marking area on the top center map section identifying the top center contained materials;

marking the bottom center marking area on the bottom center map section identifying the bottom center contained materials.

5. The process of claim 4, further comprising:

covering the top left contained materials, the top right contained materials, the bottom left contained materials and the bottom right contained materials with ice.

* * * * *